United States Patent [19]

Bloemhof

[11] Patent Number: 4,971,524

[45] Date of Patent: Nov. 20, 1990

[54] GAS-DYNAMIC PRESSURE-WAVE MACHINE WITH REDUCED NOISE AMPLITUDE

[75] Inventor: Hinne Bloemhof, Aesch, Switzerland

[73] Assignee: Asea Brown Boveri Ltd., Baden, Switzerland

[21] Appl. No.: 486,219

[22] Filed: Feb. 28, 1990

[30] Foreign Application Priority Data

Mar. 2, 1989 [DE] Fed. Rep. of Germany ..... 3906552

[51] Int. Cl.[5] ..... F02B 33/42; B28B 3/26

[52] U.S. Cl. ..... 417/64

[58] Field of Search ..... 417/64; 60/39.45 A; 123/559.2

[56] References Cited

U.S. PATENT DOCUMENTS 3,556,680 1/1971 Leutwyler et al. ..... 417/64

4,288,203 9/1981 Fried et al. ..... 417/64

FOREIGN PATENT DOCUMENTS 398184 2/1966 Switzerland .

*Primary Examiner*—Michael Koczo

*Assistant Examiner*—Robert N. Blackmon

*Attorney, Agent, or Firm*—Oblon, Spivak, McClelland, Maier & Neustadt

[57] ABSTRACT

In a multiflow gas-dynamic pressure-wave machine, with a rotor, a housing surrounding the rotor as well as an air housing and a gas housing with ducts for the intake and discharge of the gaseous working substance, the cell ring of the rotor is subdivided by two intermediate pipes placed between a hub pipe and a shroud band into three concentric flows. The radially directed cell walls of the flows are mutually offset in the circumferential direction. The middle flow in the radial direction is dimensioned higher than the inner and outer flow. The cells of the three flows in the circumferential direction exhibit an uneven division.

4 Claims, 2 Drawing Sheets

FIG.1
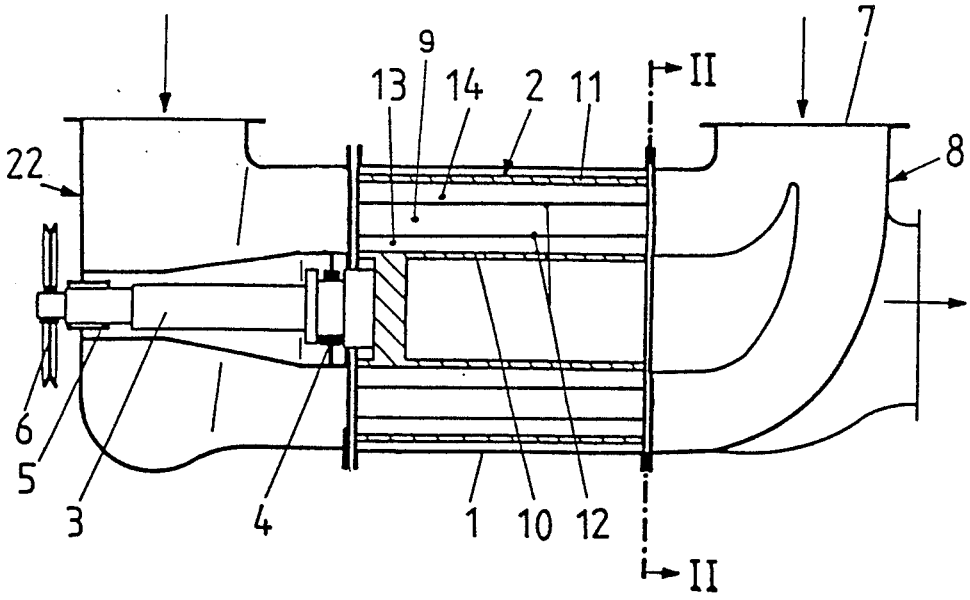
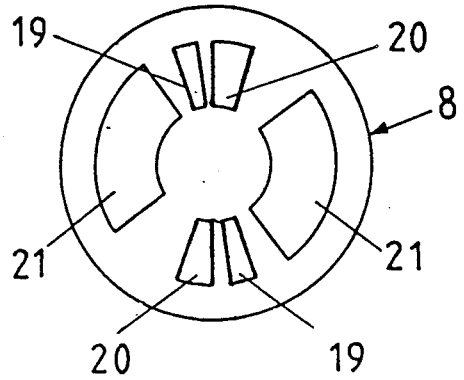
FIG. 2

GAS-DYNAMIC PRESSURE-WAVE MACHINE WITH REDUCED NOISE AMPLITUDE

BACKGROUND OF THE INVENTION

1. Field of the Invention

This invention relates to a multiflow gas-dynamic pressure-wave machine.

2. Discussion of the Related Art

Single-flow pressure-wave machines cause noise annoyance, which should be reduced in view of the constantly increasing demands of environmentalists and in the justified interest of the public.

For this purpose, various solutions have already been proposed. One of these proposals (CH-PS No. 398 184) provides for subdividing the height of the cells of the rotor, in which the pressure exchange between the gaseous working substance takes place, to produce several circular flows which are divided in the radial direction by circular cylindrical intermediate pipes in order to place the fundamental frequency of the sound vibrations above the upper audibility threshold of the human ear. In a first embodiment of such a rotor the divisions of the adjacent cells are randomly different, but equal in all flows, so that all cell walls of the cells adjacent to one another in the radial direction are in common radial planes, while in a second embodiment the cell walls of flows radially adjacent to one another are randomly mutually offset in the circumferential direction. In another embodiment, only one flow is provided, and the cell walls consist of curved pieces of sheet metal with ends bent in the shape of hooks, the latter can be cast integral in the hub pipe or in the outside jacket of the rotor. However, the intended effect is not achieved in all these embodiments since only several vibrations of the same frequency are superposed and the fundamental frequency is kept.

The described design further exhibits disadvantages relating to stability. As a result of the circular cross section of the intermediate pipes, of the cell walls which are uniformly thick and offset relative to one another, and of the different size cell divisions, thermal and centrifugal force stresses occur which cause deformations and overstresses of the rotor structure. In the last-named variant, because of the great elasticity of the cell walls, especially during speed variations, torsion vibrations of the walls also occur, which can disturb the pressure wave process.

SUMMARY OF THE INVENTION

An object of the invention is to avoid these drawbacks with respect to noise reduction by reducing the amplitude of the fundamental frequency via mutual interference.

The above, and other, objects are achieved according to the present invention by a multi-flow gas dynamic pressure wave machine including a rotor mounted in a rotor housing for rotation about a rotational axis. Air and gas housings respectively connect to opposite axial ends of the rotor housing, each of the air and gas housings having both intake ducts and discharge ducts for respectively supplying and discharging a gas flow of a gaseous working substance to and from the rotor. The rotor comprises a plurality of substantially concentric pipes having axes extending substantially parallel to the axis of rotation and dividing the gas flow through the rotor into three radially spaced concentric flows. A plurality of substantially radially extending cell walls extend between adjacent ones of the concentric pipes to form a plurality of cells dividing each of the concentric flows into a plurality of circumferentially spaced flows. The concentric pipes are spaced such that the middle one of the three concentric flows has a radial height greater than that of the others of the concentric flows.

According to a feature of the invention, the cell walls extending between adjacent ones of the concentric pipes are mutually circumferentially offset to produce interference in the gas pressure pulsations, thereby reducing noise.

According to a further feature of the invention, the concentric pipes are spaced such that the radially inner and outer ones of the three concentric flows have the same radial height.

According to yet a further feature of the invention, the cell walls of each of the concentric flows have uneven circumferential widths.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1 shows a three-flow pressure-wave machine according to the invention in longitudinal section;

FIG. 2, is a view along line II—II in FIG. 1 and shows the waste-gas and air ducts in a housing side part.

DETAILED DESCRIPTION OF THE PREFERRED EMBODIMENT

Figure 3:
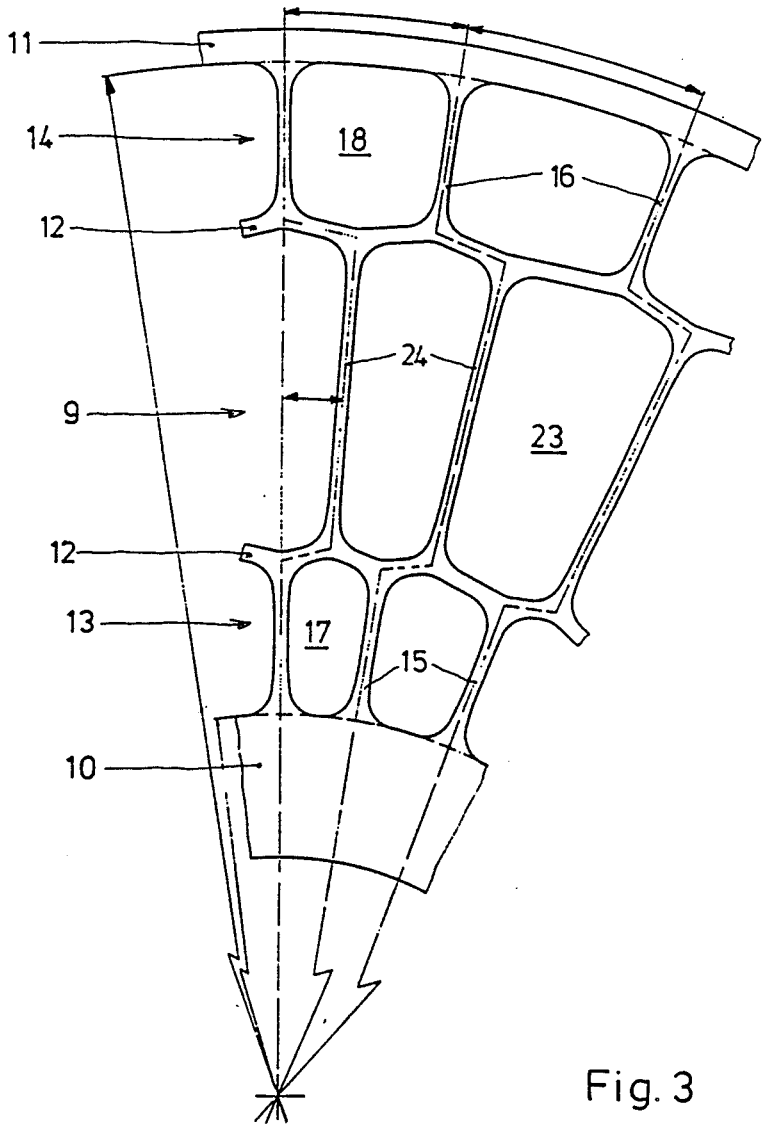
FIG. 3 shows the rotor of the machine according to FIG. 1 in a partial end elevation.

In FIG. 1 a rotor housing surrounds rotor 2. This rotor is rigidly connected to a shaft 3, which is support to rotate about a rotational axis in two bearings 4 and 5 and can be driven by a V-belt wheel 6.

FIG. 2 is an end view of the flange side of gas housing 8 corresponding to line II—II indicated in FIG. 1. In this figure, the two intake ducts for the high-pressure gas are identified by 19, the gas pockets, which increase the operating area of the pressure-wave machine in a known way, are identified by 20, and the exhaust ducts for the expanded exhaust gas are identified by 21. Corresponding ducts for the sucked-in or compressed air and pockets are also provided on the flange side of air housing 22 (see FIG. 1).

The gases coming from a combustion engine (not shown) enter at intake pipe connection 7 into gas housing 8. Rotor 2 has a hub pipe 10, a shroud pipe or band 11 and two concentric intermediate pipes 12, which limit an inner flow 13, a middle flow 9 and an outer flow 14.

From the end view of the rotor shown in FIG. 3 it can be seen that hub pipe 10 and shroud band 11, at least on the cell side, are made circular cylindrical, while intermediate pipes 12 each exhibit a zigzag cross section. The three flows are subdivided in the circumferential direction by radial cell walls 15, 16, 24. The cell walls divide all of the flows 9, 13 and 14 into an equal number of cells 17, 23, 18. The outer and inner flow are equal in height, while the middle flow is substantially greater in its radial height. Moreover, the cells of each flow are, in a way known in the art (CH-PS No. 470 588), made with different widths to achieve a more uniform, and thus a physiologically better tolerable, noise spectrum. In this case a number of narrower cells alternates with a number of wider cells according to a specific calculable scheme. The cell walls of the individual flows are mutually offset in the circumferential direction so that the cell walls of the outer and inner flows are aligned, i.e., they are on a common radial line.

By the subdivision of the cells into three flows, the number of noise-producing pressure pulses is increased threefold. By offsetting the cell walls of the middle flow with respect to the cell walls of the two other flows, as can be seen in FIG. 3, a time shift of the pressure pulses relative to one another is produced. The amplitude of the fundamental frequency is thus reduced by the resulting mutual interference. Thus interference having an amplitude-reducing action in the fundamental frequency occurs.

The effectiveness of this measure greatly depends on the noise spectrum which is produced by this rotor. In the embodied machines the intensity of the fundamental frequency has the greatest contribution (subjectively and also objectively) to noise annoyance. The contribution of the harmonic vibrations to noise production is comparatively small; the second harmonic is already 20 dB lower than the noise caused by the fundamental frequency. But in fact it is not possible to attain a total cancellation of the fundamental frequency. Theoretically that would be possible only with infinitesimally small cell sizes, since pressure fluctuations can mutually influence one another only in the immediate surroundings of the intermediate pipes. Gas particles located at a great distance from one another in the radial direction are not included in the interference action, since because of their distance they can have no effect on one another.

Since the fundamental frequency and its harmonic frequencies are all present, and only the amplitudes of the fundamental frequency and its odd-numbered multiples are reduced by offsetting the cell walls, only the even-numbered multiples of the fundamental frequency dominate in the remaining noise spectrum.

The variation of the cell height according to the invention in the three flows is based on the knowledge that interference is possible only with coherent wave fronts in the area immediately near the origin of the waves. In a three-flow rotor with three flows of equal height, too small a space is available, as a result of the uniformly modest cell height, for interference to take place. Consequently the cells of the middle flow are designed higher than those of the adjacent flows.

The radially inner ends of cell walls 16 of outer flow 14 merge with the outer intermediate pipe 12 at its peaks, while cell walls 24 of middle flow 9 merge with the outer intermediate pipe 12 at its troughs. Conversely, the radially outer ends of cell walls 15 of the inner flow 13 merge with the inner intermediate pipe 12 at its troughs, while cell walls 24 of middle flow 9 merge with the inner intermediate pipe 12 at its peaks. Thus, the cell walls extend, between hub pipe 10 or shroud band 11 and the portions of zigzag intermediate pipes 12 turned toward them.

From FIG. 2 it can be seen that the edges of ducts 19 and 21, as well as of pockets 20 running crosswise to the peripheral direction of the rotor, run in a straight line and radially. If cell walls 15, 16, 24 of rotor 2, as is the case in the embodiment of the rotor shown in FIG. 3, are also made radial and straight, this results in the cell ducts of all flows of the rotor opening abruptly opposite the stationary ducts in the air and gas housings so that the free duct cross section greatly increases. The intermittent inflow of gas or air caused by this sudden cross sectional increase can lead to subjectively more unpleasant noises, since because of the pressure profile higher frequency portions are produced, whose elimination or at least attenuation is sought.

Tests have shown that the noise portion attributable to this source can be reduced by the boundary edges of the intake and discharge ducts for air and gas running crosswise to the peripheral direction not extending radial but in the direction of a secant, in a way not shown, or in the form of a wave line extending substantially in the radial direction.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A multiflow gas-dynamic pressure-wave machine, comprising:

a rotor housing;

a rotor mounted in said housing for rotation about a rotational axis; and air and gas housings respectively connected to opposite axial ends of said rotor housing, each of said air and gas housings having both intake ducts and discharge ducts for respectively supplying and discharging a gas flow of a gaseous working substance to and from said rotor, wherein said rotor comprises:

(a) a plurality of substantially concentric pipes having axes extending substantially parallel to said axis of rotation and dividing the gas flow through said rotor into three radially spaced concentric flows, and (b) a plurality of substantially radially extending cell walls extending between adjacent ones of said concentric pipes to form a plurality of cells dividing each of said concentric flows into a plurality of circumferentially spaced flows, wherein said concentric pipes are spaced such that the middle one of said three concentric flows has a radial height greater than the others of said concentric flows.

2. The machine of claim 1 wherein, the cell walls adjacent ones of said concentric flows are mutually circumferentially offset.

3. The machine of claim 2 wherein said concentric pipes are spaced such that the radially inner and outer ones of said three concentric flows have the same radial height.

4. The machine of claim 2 wherein the cells of each of said concentric flows have uneven circumferential widths.

* * * * *